US011674762B2

(12) United States Patent
Alomaira

(10) Patent No.: US 11,674,762 B2
(45) Date of Patent: Jun. 13, 2023

(54) BOLT ACTION FIREARM

(71) Applicant: Caracal International, LLC, Abu Dhabi (AE)

(72) Inventor: Naser Ali Alomaira, Khalifa (AE)

(73) Assignee: CARACAL INTERNATIONAL, LLC, Abu Dhabi (AE)

( * ) Notice: Subject to any disclaimer, the term of this patent is extended or adjusted under 35 U.S.C. 154(b) by 0 days.

(21) Appl. No.: 17/324,346

(22) Filed: May 19, 2021

(65) Prior Publication Data

US 2021/0381784 A1 Dec. 9, 2021

Related U.S. Application Data

(60) Provisional application No. 63/035,144, filed on Jun. 5, 2020.

(51) Int. Cl.
*F41A 3/22* (2006.01)

(52) U.S. Cl.
CPC ..... *F41A 3/22* (2013.01)

(58) Field of Classification Search
CPC ..... F41A 3/12; F41A 3/14; F41A 3/16; F41A 3/18; F41A 3/20; F41A 3/22; F41A 3/24; F41A 3/32; F41A 3/34; F41A 3/36; F41A 3/40; F41A 3/42; F41A 3/38; F41A 3/44; F41A 3/46; F41A 3/48; F41A 3/50; F41A 3/52
USPC ..... 42/14–16, 69.02, 69.03
See application file for complete search history.

(56) References Cited

U.S. PATENT DOCUMENTS

| | | | | |
|---|---|---|---|---|
| 7,950,177 | B2 * | 5/2011 | Laney | F41A 15/14 89/185 |
| 8,925,230 | B2 * | 1/2015 | Warburton | F41A 3/14 89/1.4 |
| D854,643 | S * | 7/2019 | Schafer | D22/108 |
| 10,458,731 | B2 * | 10/2019 | Mather | F41A 3/22 |
| D879,905 | S * | 3/2020 | Schafer | D22/108 |
| 2010/0257768 | A1 | 10/2010 | Barrett | |
| 2010/0281733 | A1 | 11/2010 | Constant et al. | |
| 2014/0013641 | A1 | 1/2014 | Warburton et al. | |

(Continued)

FOREIGN PATENT DOCUMENTS

| | | | | |
|---|---|---|---|---|
| DE | 9419743 | U1 * | 9/1994 | F41A 3/16 |
| EP | 0914585 | B1 | 9/2005 | |
| WO | 2016-138197 | A1 | 9/2016 | |

*Primary Examiner* — John Cooper
(74) *Attorney, Agent, or Firm* — Bennet K. Langlotz; Langlotz Patent & Trademark Works, LLC

(57) ABSTRACT

A bolt action firearm has a frame defining a bolt passage, an elongated bolt assembly configured to reciprocate within the bolt passage, the elongated bolt assembly defining a firing pin passage, a firing pin assembly received in the firing pin passage, a bolt handle having an inner end configured to removably engage the firing pin assembly and an opposed free end, the bolt handle inner end having opposed spaced-apart prongs defining a bolt handle channel, the bolt handle defining a pocket associated with the bolt handle channel, the firing pin assembly having a handle engagement portion having a first section configured to be received in the bolt handle channel, and the firing pin assembly having a second section adjacent to the first section such that when the second section is biased into the pocket, the firing pin assembly is secured against passage through the bolt handle channel.

22 Claims, 10 Drawing Sheets

(56) References Cited

U.S. PATENT DOCUMENTS

| | | | | |
|---|---|---|---|---|
| 2017/0010064 | A1* | 1/2017 | Karagias | F41A 3/14 |
| 2018/0195818 | A1* | 7/2018 | Schafer | F41A 15/12 |
| 2018/0195823 | A1* | 7/2018 | Schafer | F41A 19/30 |
| 2019/0078849 | A1* | 3/2019 | Schafer | F41A 3/22 |
| 2020/0263942 | A1* | 8/2020 | Karagias | F41A 15/14 |

* cited by examiner

BOLT ACTION FIREARM

CROSS-REFERENCE TO RELATED APPLICATION

This application claims the benefit of U.S. Provisional Patent Application No. 63/035,144 filed on Jun. 5, 2020, entitled "BOLT FOR SNIPER BOLT ACTION FIREARM," which is hereby incorporated by reference in its entirety for all that is taught and disclosed therein.

FIELD OF THE INVENTION

The present invention relates to firearms, and more particularly to a bolt action firearm that enables the bolt assembly to be easily assembled and disassembled and minimizes the weight of the bolt assembly.

BACKGROUND AND SUMMARY OF THE INVENTION

Bolt action firearms provide many advantages to the user, including enhanced accuracy, reliability, and ease of use. Conventional bolt assemblies can have significant disadvantages, including difficulty of assembly during manufacture and challenges associated with field stripping, such as requiring tools. Conventional bolt assemblies can also be heavy because all the parts must be designed to withstand chamber pressures when the host firearm is fired.

Therefore, a need exists for a new and improved bolt action firearm that enables the bolt assembly to be easily assembled and disassembled and minimizes the weight of the bolt assembly. In this regard, the various embodiments of the present invention substantially fulfill at least some of these needs. In this respect, the bolt action firearm according to the present invention substantially departs from the conventional concepts and designs of the prior art, and in doing so provides an apparatus primarily developed for the purpose of enabling the bolt assembly to be easily assembled and disassembled and minimizes the weight of the bolt assembly.

The present invention provides an improved bolt action firearm, and overcomes the above-mentioned disadvantages and drawbacks of the prior art. As such, the general purpose of the present invention, which will be described subsequently in greater detail, is to provide an improved bolt action firearm that has all the advantages of the prior art mentioned above.

To attain this, the preferred embodiment of the present invention essentially comprises a frame defining a bolt passage, an elongated bolt assembly configured to reciprocate within the bolt passage, the elongated bolt assembly defining a firing pin passage, a firing pin assembly received in the firing pin passage and configured to reciprocate between a forward and rearward position, a bolt handle having an inner end configured to removably engage the firing pin assembly and an opposed free end, the bolt handle inner end having opposed spaced-apart prongs defining a bolt handle channel having a first width, the bolt handle defining a pocket associated with the bolt handle channel and having a second width greater than the first width, the firing pin assembly having a handle engagement portion having a first section having a first thickness configured to be received in the bolt handle channel, and the firing pin assembly having a second section adjacent to the first section and having a second thickness greater than the first width and less than the second width, such that when the second section is biased into the pocket, the firing pin assembly is secured against passage through the bolt handle channel. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
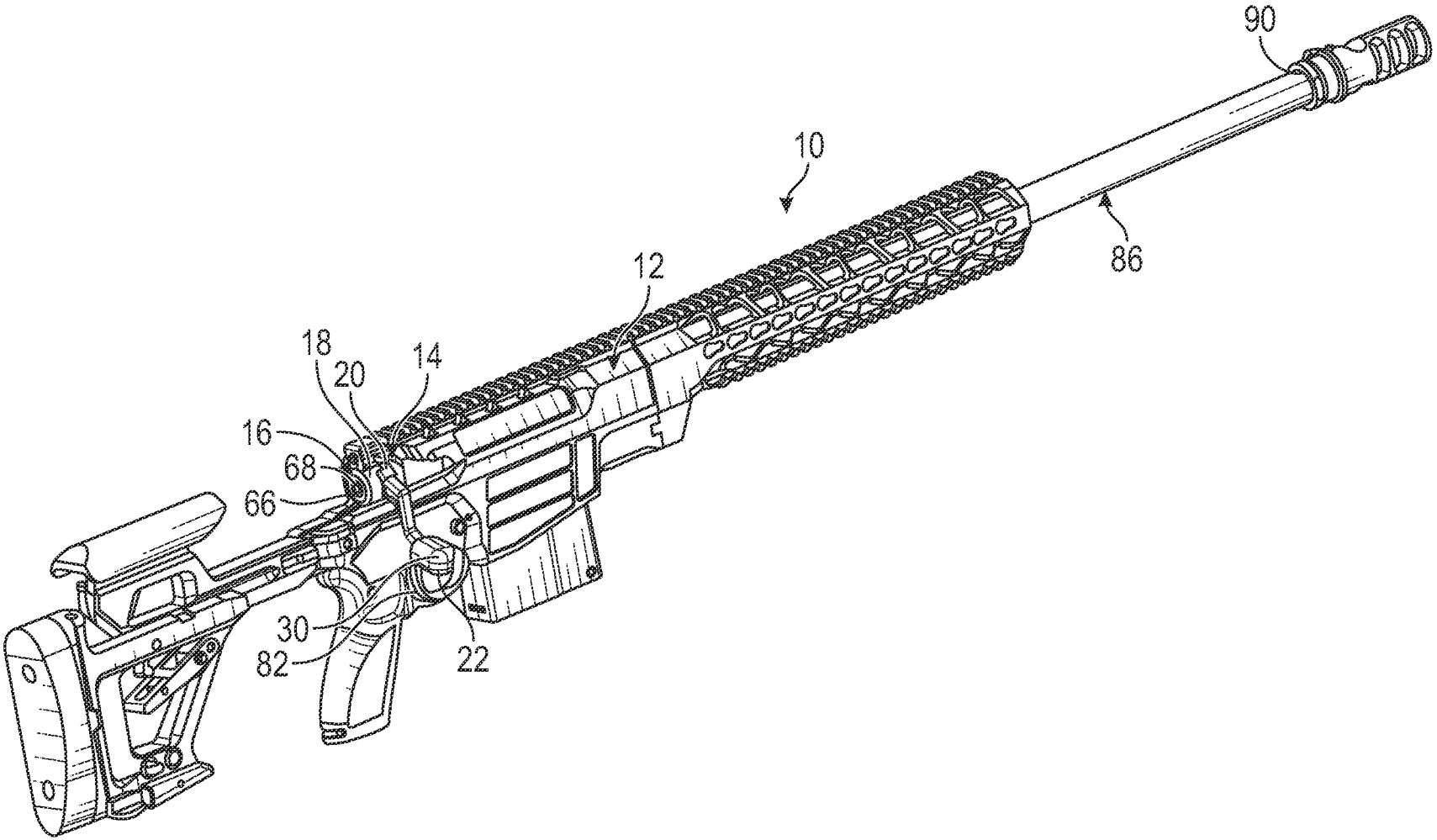
FIG. 1 is a top isometric view of the current embodiment of a bolt action firearm constructed in accordance with the principles of the present invention in use attached to a rifle.

An embodiment of the bolt action firearm of the present invention is shown and generally designated by the reference numeral 10.

FIG. 1 illustrates the improved bolt action firearm 10 of the present invention. More particularly, the bolt action firearm has a frame 12 defining a bolt passage 14. The bolt passage receives an elongated bolt assembly 16 configured to reciprocate within the bolt passage. The elongated bolt assembly includes a bolt carrier 18 that defines a handle passage 20 that receives one end of a bolt handle 22.

Figure 2:
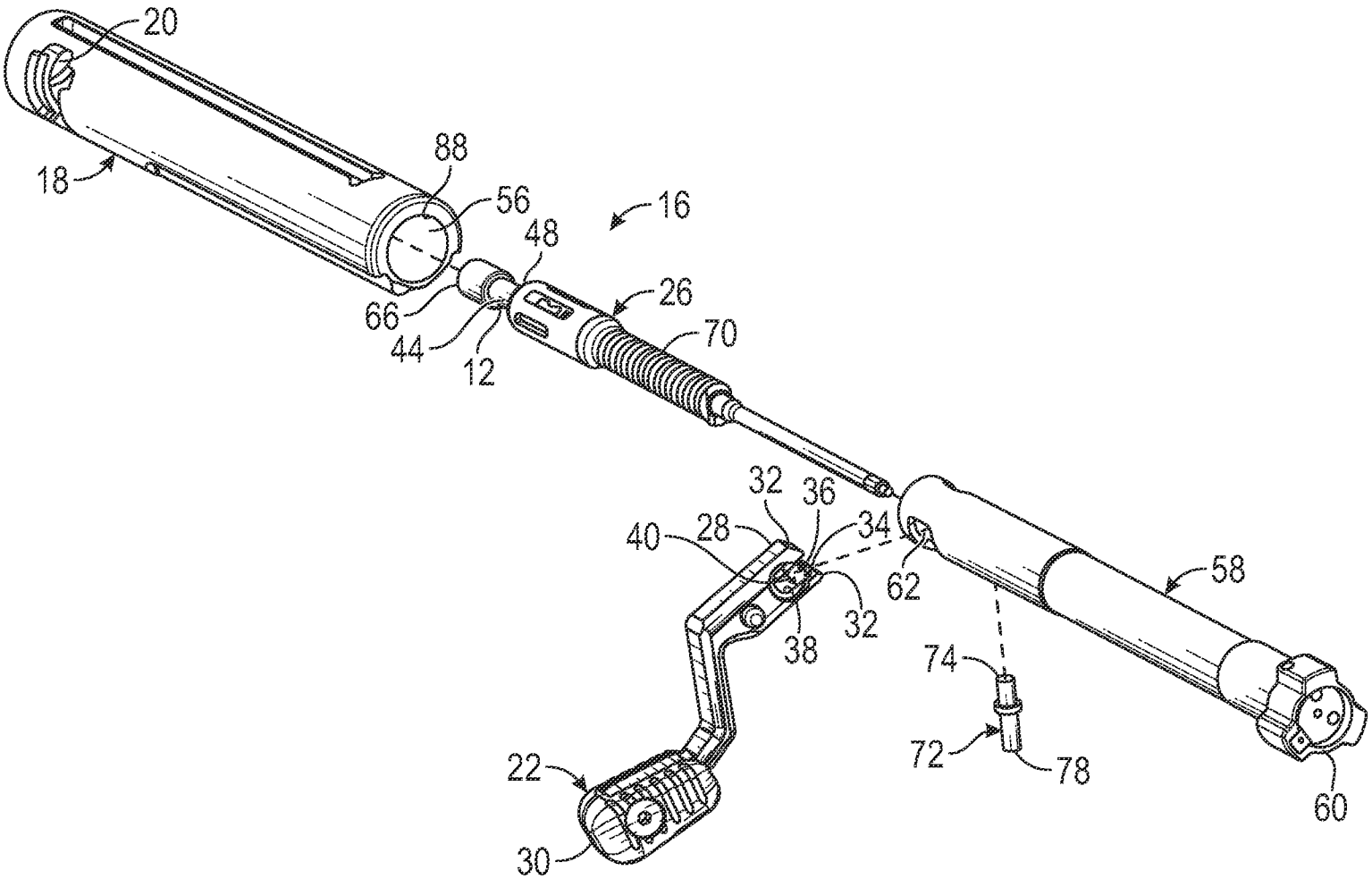
FIG. 2 is an exploded view of the bolt assembly of FIG. 1 detached from the rifle.
Figure 3:
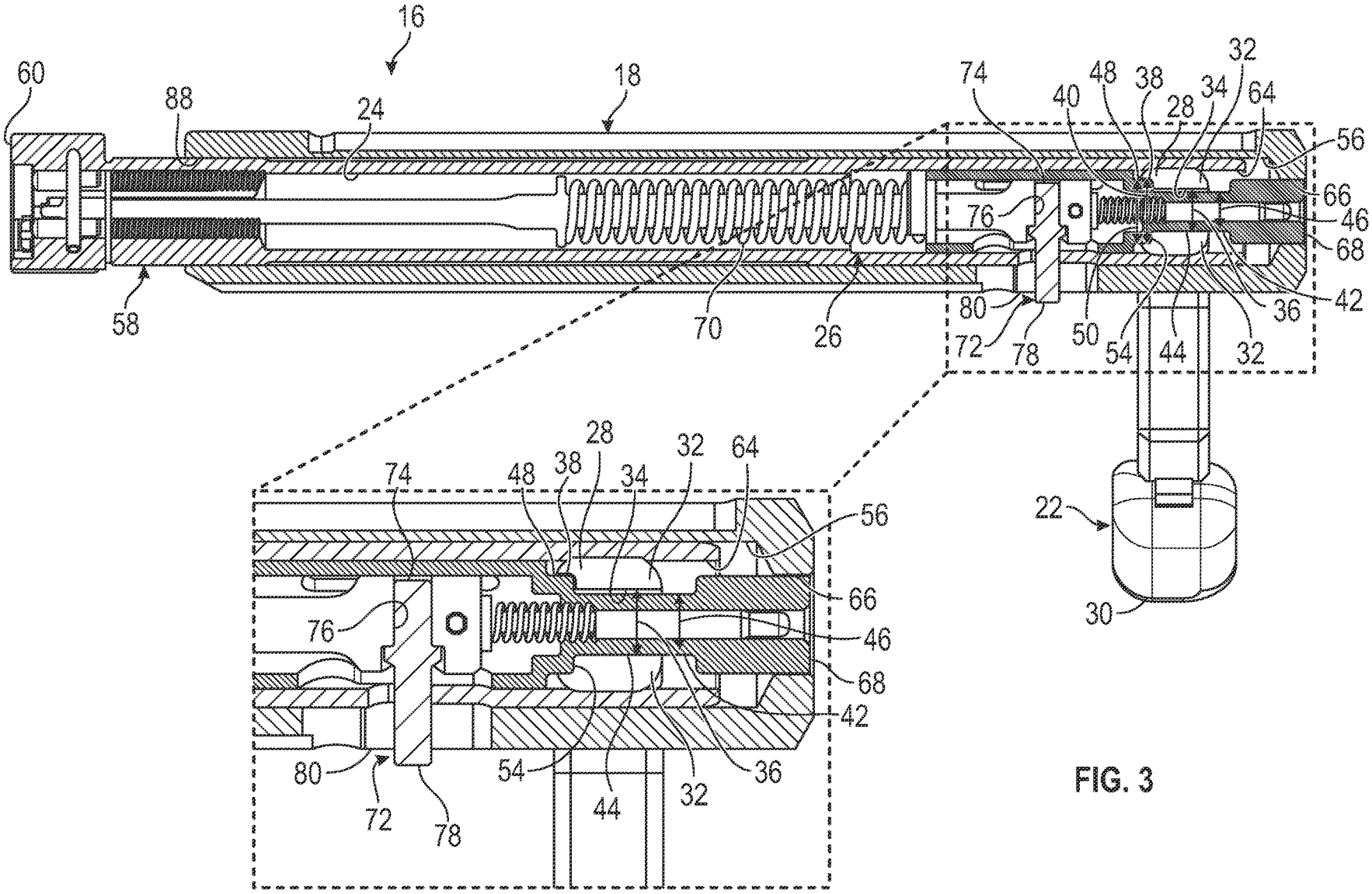
FIG. 3 is a side sectional view of the bolt assembly of FIG. 2.
Figure 4:
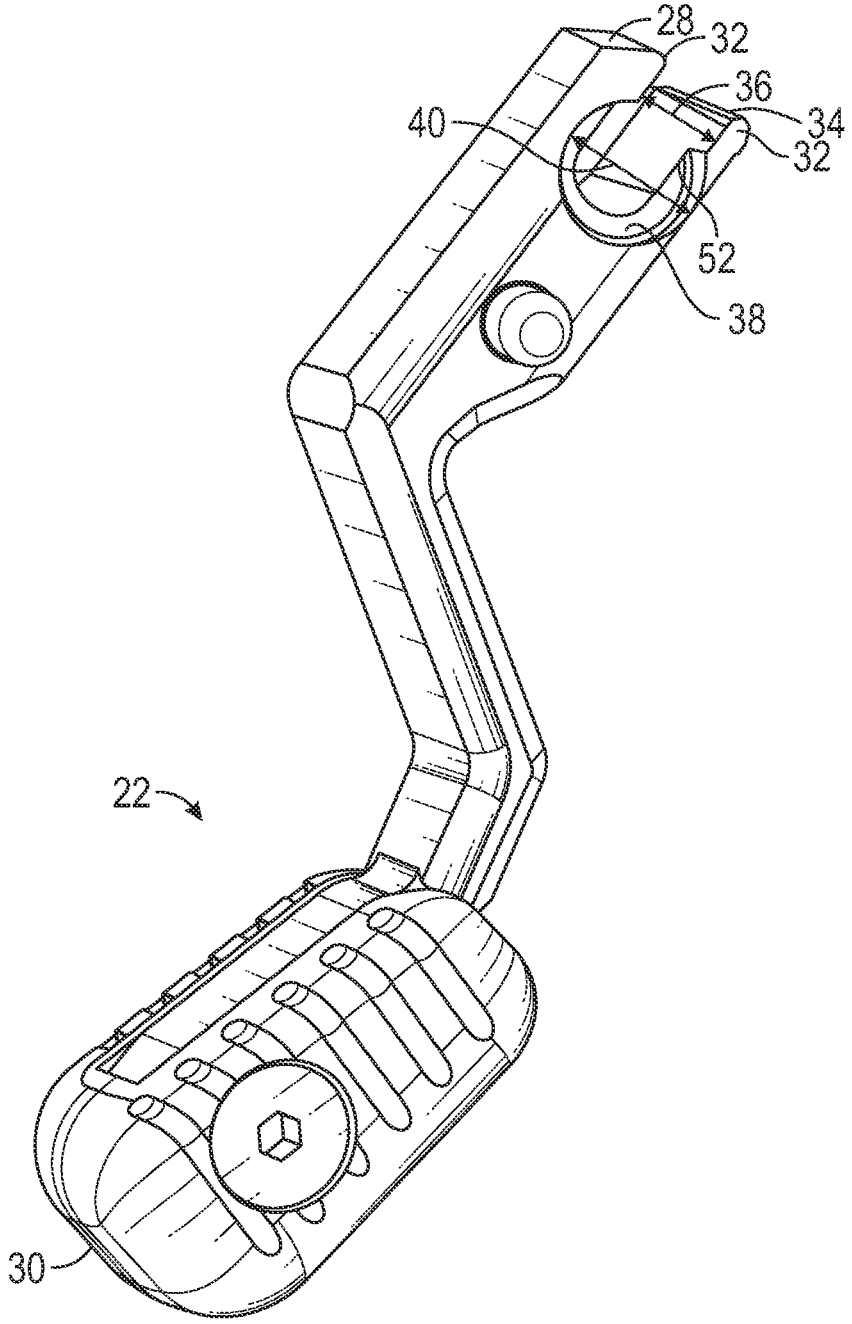
FIG. 4 is an enlarged view of the bolt handle of FIG. 1 detached from the bolt assembly.

FIGS. 2-3 illustrate the improved elongated bolt assembly 16 of the present invention. FIG. 4 illustrates the improved bolt handle 22 of the present invention. More particularly, the elongated bolt assembly includes a bolt carrier 18 defining a passage 56 receiving a bolt body 58 having a bolt face 60. The bolt defines a firing pin passage 24. A firing pin assembly 26 is received in the firing pin passage and configured to reciprocate between a forward and rearward position. The bolt handle has an inner end 28 configured to removably engage the firing pin assembly and an opposed free end 30. The bolt handle inner end has opposed spaced-apart prongs 32 defining a bolt handle channel 34 having a first width 36. The bolt handle defines a pocket 38 associated with a bolt handle channel having a second width 40 greater than the first width. The firing pin assembly has a handle engagement portion 42 having a first section 44 having a first thickness 46 configured to be received in the bolt handle channel. The firing pin assembly has a second section 48 adjacent to the first section having a second thickness 50. The second thickness is greater than the first width and less than the second width such that when the second section is biased into the pocket by spring 70, the firing pin assembly is secured against passage through the bolt handle channel.

As is shown in FIG. 4, pocket 38 has a wall portion 52 facing at least in part away from the inner end 28 and configured to prevent removal of the bolt handle 22 from the firing pin assembly 26 when the second section 48 of the firing pin assembly is in the pocket. In the current embodiment, the wall portion is cylindrical. The second section 48 of the firing pin assembly has a shoulder 54 at the first section 44. In the current embodiment, the shoulder is a flat surface. The bolt body 58 portion of the elongated bolt assembly 16 defines a handle aperture 62 lateral to the firing pin passage 24 and configured to receive the bolt handle.

The bolt carrier 18 and the bolt body 58 are formed of different materials in the current embodiment. In one embodiment, the bolt carrier can be formed of aluminum to reduced weight, and the bolt can be formed of steel to be capable of withstanding the stresses resulting from discharge of the bolt action firearm 10 The firing pin passage has an open end 64, and the passage 56 has an open end 66 axially registered with the open end 64. The firing pin assembly 26 has an actuation end 68 accessible via the open end 66 of the passage and open end 64 of the firing pin passage. The firing pin assembly is movable in response to force at the actuation end to move the second section 48 forward out of the pocket 38 to enable extraction of the bolt handle 22. A firing pin mount 72 has one end 74 received in a bore 76 in the firing pin assembly and an opposed end 78 protruding from a slot 80 in the bolt carrier.

Figure 5A:
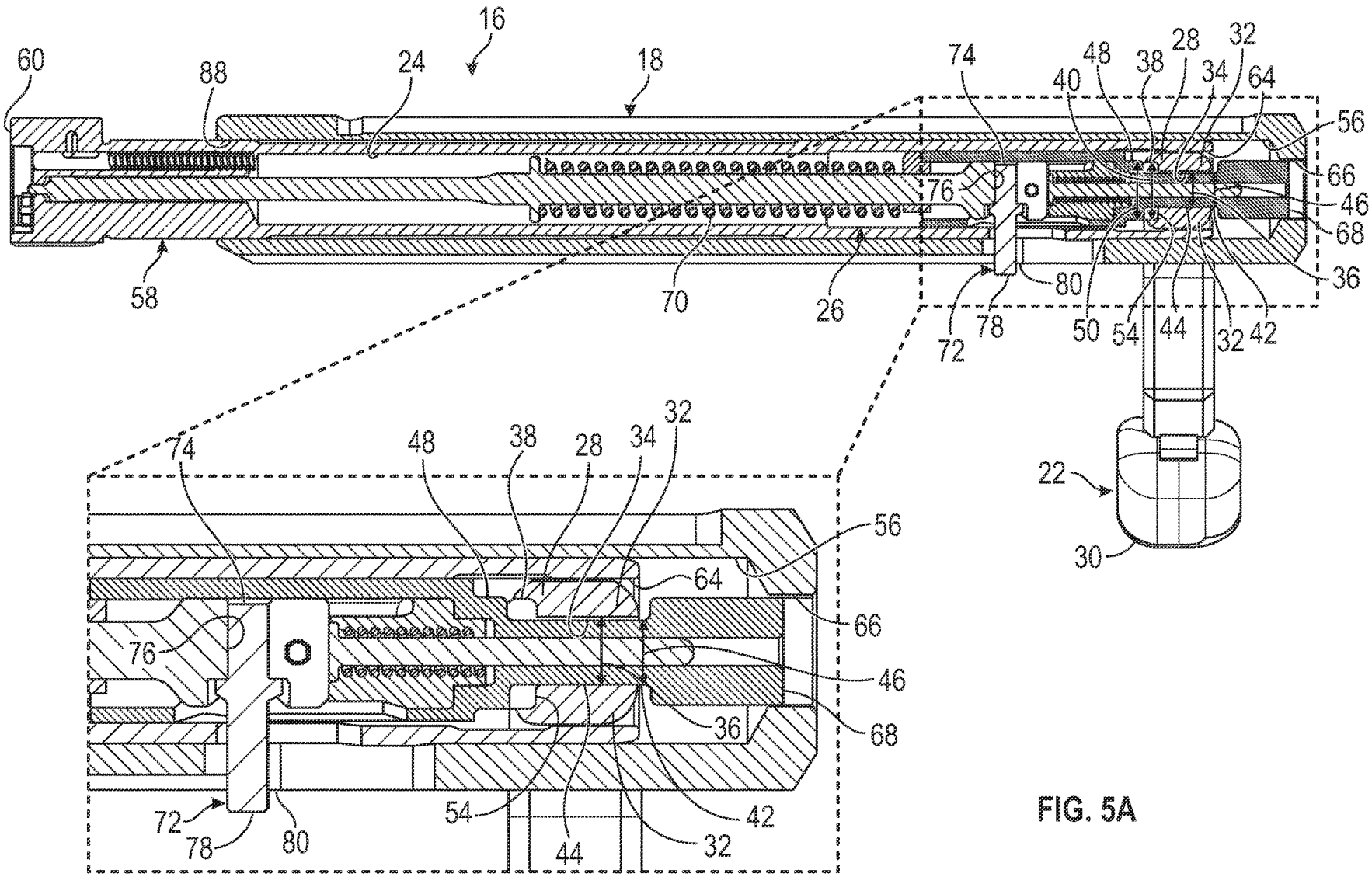
FIG. 5A is a side sectional view of the bolt assembly of FIG. 2 with the bolt handle attached.
Figure 5B:
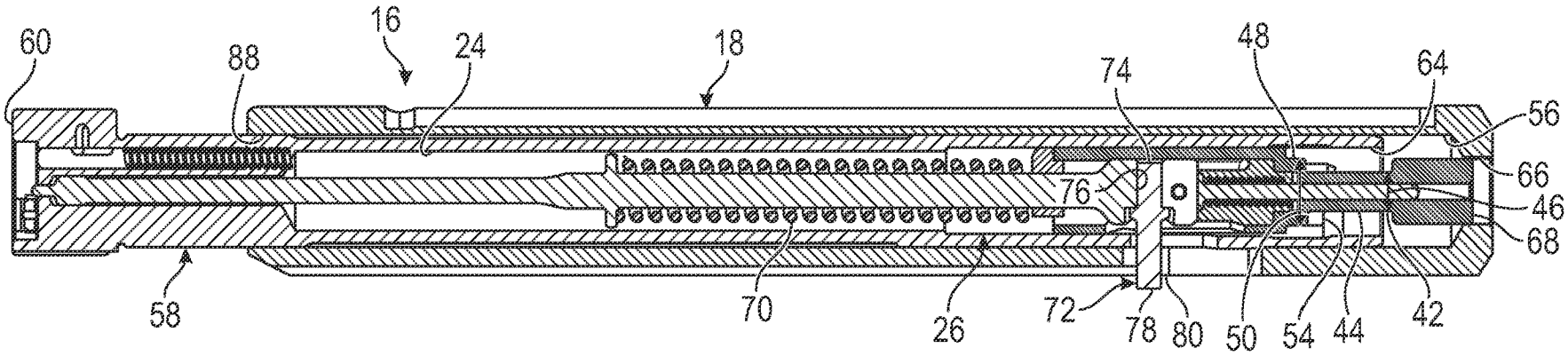
FIG. 5B is a side sectional view of the bolt assembly of FIG. 2 with the bolt handle removed.

FIGS. 5A-B illustrate the improved elongated bolt assembly 16 of the present invention. More particularly, FIGS. 5A-B show the actuation end 66 of the firing pin assembly 26 having been pushed forward relative to the normal operating position shown in FIG. 3 to enable extraction of the bolt handle 22. As can be seen in FIG. 5A, the second section 48 of the handle engagement portion 42 has been moved forward out of the pocket 38 in the inner end 28 of the bolt handle to enable extraction of the bolt handle through handle aperture 62 in the bolt body 58 and handle passage 20 in the bolt carrier 18. Shoulder 54 is no longer obstructed by the wall portion 52. FIG. 5B is identical to FIG. 5A except for showing the elongated bolt assembly after the bolt handle has been removed as the first step in disassembly of the elongated bolt assembly.

Figure 6:
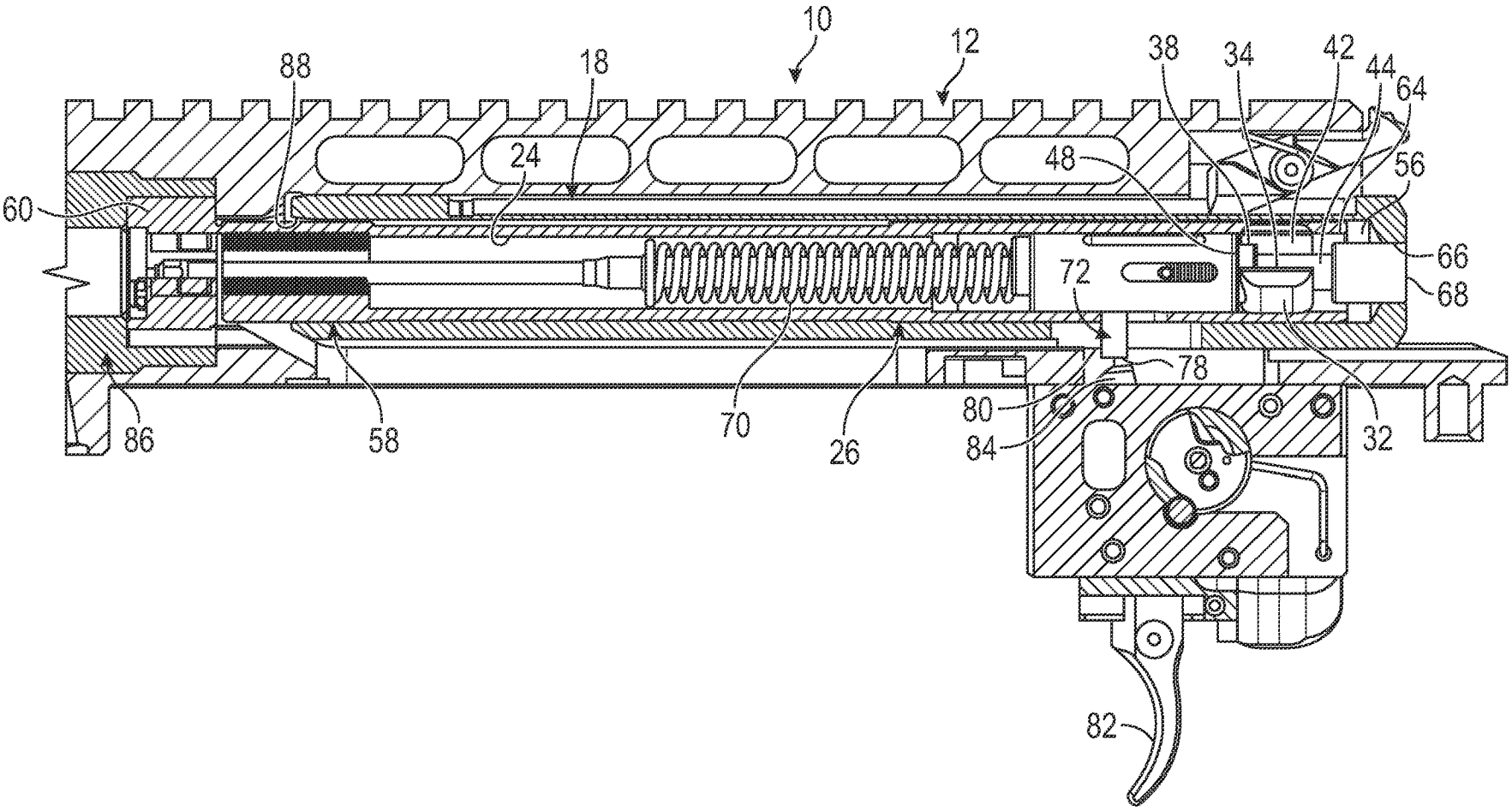
FIG. 6 is a side sectional view of the bolt action firearm of FIG. 1 after the bolt action firearm has been discharged.

FIG. 6 illustrates the bolt action rifle 10 after discharge when the trigger 82 has been pulled to release the firing pin mount 72 from being held back in the cocked position by the sear 84. The firing pin assembly 26 has traveled forward so the firing pin assembly can discharge a cartridge (not shown) chambered in the barrel 86 of the bolt action rifle. It should be appreciated that the firing pin mount does not travel so far forward during discharge that the firing pin mount can disengage from the bore 76 in the firing pin assembly.

Figure 7:
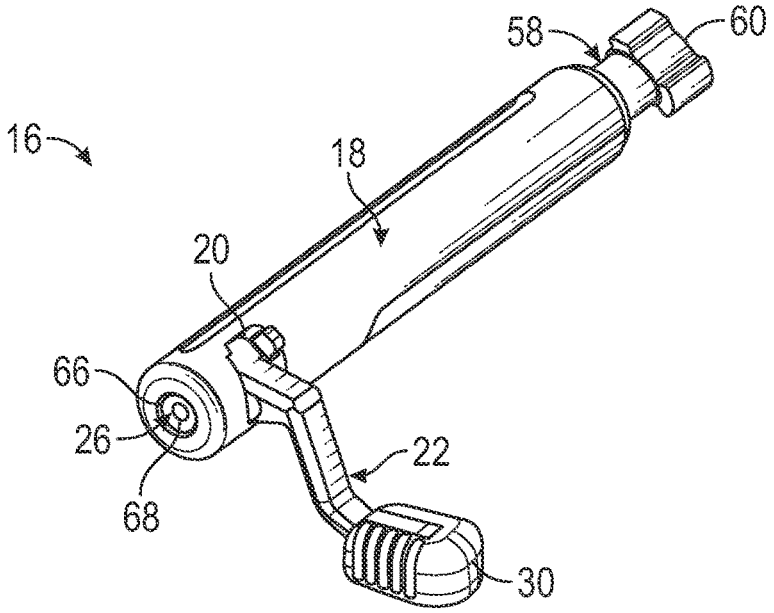
FIG. 7 is a top isometric view of the bolt assembly of FIG. 2 with the bolt handle attached prior to disassembly.
Figure 8:
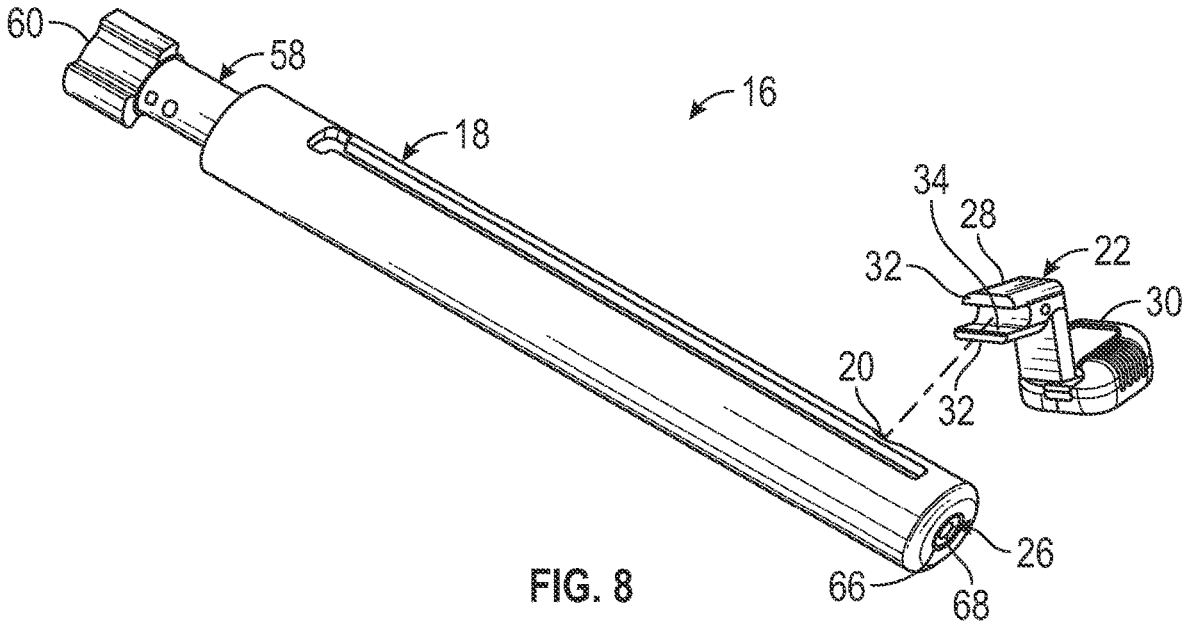
FIG. 8 is a partially exploded view of the bolt assembly of FIG. 2 with the bolt handle removed showing the first step of disassembly.
Figure 9:
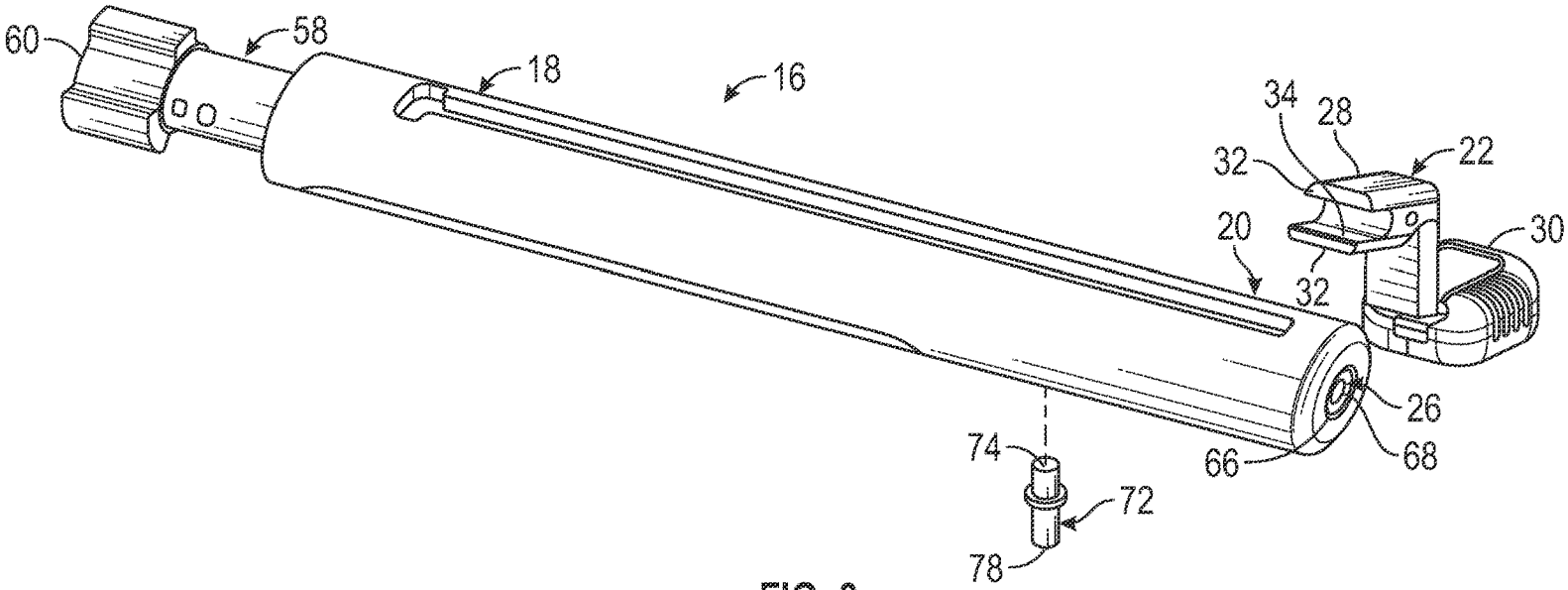
FIG. 9 is a partially exploded view of the bolt assembly of FIG. 2 with bolt handle and firing pin mount removed showing the second step of disassembly.
Figure 10:
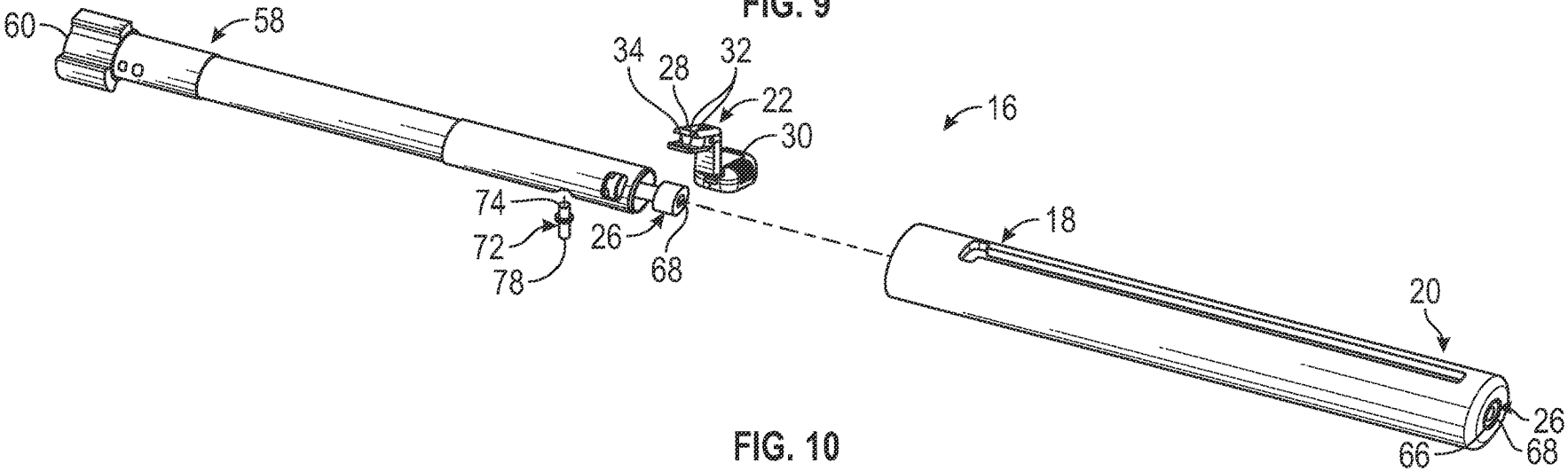
FIG. 10 is a partially exploded view of the bolt assembly of FIG. 2 with the bolt handle, firing pin mount, and bolt carrier removed showing the third step of disassembly.
Figure 11:
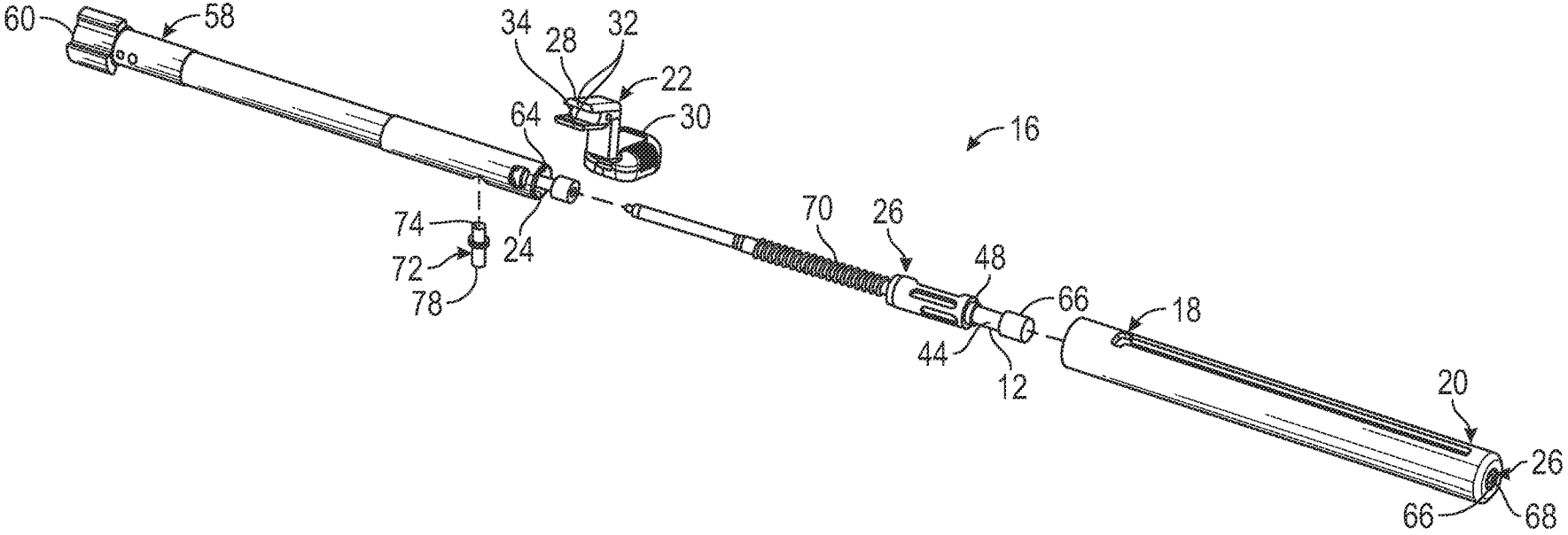
FIG. 11 is an exploded view of the bolt assembly of FIG. 2 showing the bolt assembly fully disassembled.

FIGS. 7-11 illustrate the improved elongated bolt assembly 16 of the present invention. More particularly, the figures illustrate the sequence to disassemble the elongated bolt assembly. FIG. 7 shows the elongated bolt assembly in the normal operating condition, which is the condition the elongated bolt assembly is in after having been removed from the bolt passage 14 of the frame 12 of the bolt action rifle 10. FIG. 8 shows the elongated bolt assembly in the first step of disassembly. The actuation end 68 of the firing pin assembly 26 has been pushed forward through the open end 66 of the bolt carrier 18 and the open end 64 of the firing pin passage 24 so the bolt handle 22 can be extracted as described previously. FIG. 9 shows the elongated bolt assembly in the second step of disassembly. After the bolt handle has been extracted, the firing pin assembly can be pushed further forward so the firing pin mount 72 can be extracted from the bore 76 in the firing pin assembly through slot 80 in the bolt carrier 18. FIG. 10 shows the elongated bolt assembly in the third step of disassembly. After the firing pin mount has been extracted, the bolt body 58 can be withdrawn from the bolt carrier through the forward opening 88 in the passage 56 in the bolt carrier. FIG. 11 shows the elongated bolt assembly in the fully disassembled condition. After the bolt body has been withdrawn from the bolt carrier, the firing pin assembly can be withdrawn rearwardly through the open end 64 of the firing pin passage 24 in the bolt body.

In the context of the specification, the terms "rear" and "rearward," and "front" and "forward" have the following definitions: "rear" or "rearward" means in the direction away from the muzzle 90 of the firearm while "front" or "forward" means it is in the direction towards the muzzle of the firearm.

While a current embodiment of a bolt action firearm has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly, and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bolt action firearm comprising;

a frame defining a bolt passage;

an elongated bolt assembly configured to reciprocate within the bolt passage;

the elongated bolt assembly defining a firing pin passage;

a firing pin assembly received in the firing pin passage and configured to reciprocate between a forward and rearward position;

a bolt handle having an inner end configured to removably engage the firing pin assembly and an opposed free end;

the bolt handle inner end having opposed spaced-apart prongs defining a bolt handle channel having a first width;

the bolt handle defining a pocket associated with the bolt handle channel and having a second width greater than the first width;

the firing pin assembly comprising a flexible spring having opposed ends and a rigid body interfacing the spring and having a handle engagement portion having a first section having a first thickness configured to be received in the bolt handle channel; and the rigid body of the firing pin assembly having a second section adjacent to the first section and having a second thickness greater than the first width and less than the second width, such that when the second section is biased into the pocket, the firing pin assembly is secured against passage through the bolt handle channel.

2. The bolt action firearm of claim 1 wherein the pocket has a wall portion facing at least in part away from the inner end and configured to prevent removal of the bolt handle from the firing pin assembly when the second section of the firing pin assembly is in the pocket.

3. The bolt action firearm of claim 2 wherein the wall portion is cylindrical.

4. The bolt action firearm of claim 1 wherein the second section of the rigid body has a shoulder at the first section.

5. The bolt action firearm of claim 4 wherein the shoulder is a flat surface.

6. The bolt action firearm of claim 1 wherein the elongated bolt assembly defines a handle aperture lateral to the firing pin passage and configured to receive the bolt handle.

7. The bolt action firearm of claim 1 wherein the elongated bolt assembly includes a bolt carrier defining a passage receiving a bolt having a bolt face.

8. The bolt action firearm of claim 7 wherein the bolt carrier and bolt are formed of different materials.

9. The bolt action firearm of claim 1 wherein the firing pin passage has an open end, and the firing pin assembly has an actuation end accessible via the open end of the firing pin passage.

10. The bolt action firearm of claim 9 wherein the firing pin assembly is movable in response to force at the actuation end to move the second section out of the pocket to enable extraction of the bolt handle.

11. The bolt action firearm of claim 1 wherein the firing pin assembly includes an elongated firing pin, and the rigid body defines a bore receiving a portion of the firing pin.

12. A bolt assembly configured to operate within a bolt passage of a firearm, the bolt assembly comprising;

a bolt body defining a firing pin passage;

a firing pin assembly received in the firing pin passage and configured to reciprocate between a forward and rearward position;

a bolt handle having an inner end configured to removably engage the firing pin assembly and an opposed free end;

the bolt handle inner end having opposed spaced-apart prongs defining a bolt handle channel having a first width;

the bolt handle defining a pocket associated with the bolt handle channel and having a second width greater than the first width;

the firing pin assembly comprising a flexible spring having opposed ends and a rigid body interfacing the spring and having a handle engagement portion having a first section having a first thickness configured to be received in the bolt handle channel;

the rigid body of the firing pin assembly having a second section adjacent to the first section and having a second thickness greater than the first width and less than the second width, such that when the second section is biased into the pocket, the firing pin is secured against passage through the bolt handle channel.

13. The bolt assembly of claim 12 wherein the pocket has a wall portion facing at least in part away from the inner end and configured to prevent removal of the bolt handle from the firing pin assembly when the second section of the firing pin assembly in in the pocket.

14. The bolt assembly of claim 13 wherein the wall portion is cylindrical.

15. The bolt assembly of claim 12 wherein the second section of the rigid body has a shoulder at the first section.

16. The bolt assembly of claim 15 wherein the shoulder is a flat surface.

17. The bolt assembly of claim 12 wherein the bolt assembly defines a handle aperture lateral to the firing pin passage and configured to receive the bolt handle.

18. The bolt assembly of claim 12 wherein the bolt assembly includes a bolt carrier defining a passage receiving a bolt having a bolt face.

19. The bolt assembly of claim 18 wherein the bolt carrier and bolt are formed of different materials.

20. The bolt assembly of claim 12 wherein the firing pin passage has an open end, and the firing pin assembly has an actuation end accessible via the open end of the firing pin passage.

21. The bolt assembly of claim 20 wherein the firing pin assembly is movable in response to force at the actuation end to move the second section out of the pocket to enable extraction of the bolt handle.

22. The bolt assembly of claim 12 wherein the firing pin assembly includes an elongated firing pin, and the rigid body defines a bore receiving a portion of the firing pin.

* * * * *